US007670153B2

(12) United States Patent
Kulig

(10) Patent No.: US 7,670,153 B2
(45) Date of Patent: Mar. 2, 2010

(54) ELECTRICAL CONNECTOR

(75) Inventor: Thomas A. Kulig, Orlando Park, IL (US)

(73) Assignee: Burndy Technology LLC, Manchester, NH (US)

( * ) Notice: Subject to any disclaimer, the term of this patent is extended or adjusted under 35 U.S.C. 154(b) by 0 days.

(21) Appl. No.: 11/900,378

(22) Filed: Sep. 10, 2007

(65) Prior Publication Data

US 2009/0068873 A1 Mar. 12, 2009

(51) Int. Cl.
*H01R 4/66* (2006.01)

(52) U.S. Cl. ..... 439/92; 439/432

(58) Field of Classification Search ..... 439/92, 439/94, 95, 97, 100, 107, 108, 801, 806, 439/431, 432, 104, 877, 110, 81 S; 174/94 S, 174/94 R See application file for complete search history.

(56) References Cited

U.S. PATENT DOCUMENTS

| | | | | | |
|---|---|---|---|---|---|
| 1,243,799 | A | | 10/1917 | Bissell | 411/397 |
| 2,219,846 | A | * | 10/1940 | Meyer | 439/791 |
| 2,632,068 | A | * | 3/1953 | Froebel et al. | 200/51.07 |
| 2,850,934 | A | | 9/1958 | Sehn | 411/388 |
| 2,890,511 | A | * | 6/1959 | Campbell | 24/134 R |
| 2,956,108 | A | * | 10/1960 | Brenner | 174/94 R |
| 3,232,393 | A | | 2/1966 | Attwood | 403/387 |
| 3,561,317 | A | | 2/1971 | Rowell | |
| 3,730,310 | A | * | 5/1973 | Spiringer | 191/29 DM |
| 3,830,427 | A | * | 8/1974 | Polidori | 238/14.14 |
| 3,963,322 | A | | 6/1976 | Gryctko | |
| 4,041,358 | A | | 8/1977 | Donahue et al. | |
| 4,181,396 | A | | 1/1980 | Olashaw | 339/263 |
| 4,201,433 | A | * | 5/1980 | Caldwell | 439/98 |
| 4,225,165 | A | | 9/1980 | Kesselman | 292/256.67 |
| 4,256,359 | A | * | 3/1981 | Storck | 439/412 |
| 4,784,621 | A | * | 11/1988 | Auclair | 439/793 |
| 4,828,504 | A | * | 5/1989 | Franks, Jr. | 439/92 |
| 4,875,876 | A | * | 10/1989 | O'Loughlin | 439/431 |
| 5,073,121 | A | * | 12/1991 | Jaenke et al. | 439/92 |
| 5,092,797 | A | | 3/1992 | Cole et al. | |
| 5,120,168 | A | | 6/1992 | Padula | 411/5 |
| 5,160,285 | A | * | 11/1992 | Murray | 439/801 |
| 5,226,620 | A | | 7/1993 | Libert | |
| 5,240,423 | A | * | 8/1993 | Morrison | 439/92 |
| 5,286,211 | A | | 2/1994 | McIntosh | |
| 5,632,633 | A | | 5/1997 | Roosdorp et al. | |
| 5,649,445 | A | | 7/1997 | Lavoie et al. | 72/413 |
| 5,713,705 | A | | 2/1998 | Grunbichler | |

(Continued)

OTHER PUBLICATIONS

Thomas & Betts Corporation, I-Beam Ground Clamp Connector Instruction Sheet, 2 sheets.

*Primary Examiner*—T C Patel
*Assistant Examiner*—Harshad C Patel
(74) *Attorney, Agent, or Firm*—Harrington & Smith

(57) ABSTRACT

An electrical connector including a pair of connector bars and a pair of biting pads. The connecting bars are configured to be located on opposite sides of a plate section of a first member. The connector bars include holes to receive a bolt for clamping the connector bars directly against each other. The pair of biting pads are connected to the connector bars. The biting pads include surfaces which are configured to contact the opposite sides of the plate section and bite onto the opposite sides as the connector bars are clamped against each other.

21 Claims, 5 Drawing Sheets

U.S. PATENT DOCUMENTS 5,876,224 A 3/1999 Chadbourne ..... 439/110
5,966,982 A 10/1999 Mello et al. ..... 72/416
5,967,805 A * 10/1999 Auclair et al. ..... 439/100
5,997,368 A * 12/1999 Mello et al. ..... 439/877
6,042,430 A * 3/2000 Hollick ..... 439/797
6,186,799 B1 * 2/2001 Mello ..... 439/92
6,209,424 B1 4/2001 Croton et al.
6,244,517 B1 * 6/2001 Courtois et al. ..... 238/14.05
6,333,464 B1 * 12/2001 Ellison ..... 174/92
6,855,012 B2 * 2/2005 An ..... 439/793
6,857,881 B1 * 2/2005 Balfour ..... 439/92
7,104,832 B2 9/2006 Campbell et al.
7,138,580 B2 * 11/2006 Boutin ..... 174/84 R
2007/0105410 A1 * 5/2007 Wu ..... 439/76.1

* cited by examiner

ELECTRICAL CONNECTOR

BACKGROUND OF THE INVENTION

1. Field of the Invention

The invention relates to an electrical connector and, more particularly, to a connector for attachment to a plate section of a member.

2. Brief Description of Prior Developments

Thomas & Betts sells an I-Beam Ground Clamp Connector for connecting a conductor to a structural I-Beam. The Thomas & Betts connector requires a specialty lug/barrel connector attached to an end of a conductor and extensive I-beam preparation including grinding of the I-beam for a clean conductive surface. The Ground Clamp has a shear-off head, but enough of the remaining bolt can protrude from the clamp after the head is sheared to allow for unscrewing of the bolt, such as with pliers. This can defeat the intended irreversibility of the Ground Clamp.

SUMMARY OF THE INVENTION

In accordance with one aspect of the invention, an electrical connector is provided including a pair of connector bars and a pair of biting pads. The connecting bars are configured to be located on opposite sides of a plate section of a first member. The connector bars include holes to receive a bolt for clamping the connector bars directly against each other. The pair of biting pads are connected to the connector bars. The biting pads include surfaces which are configured to contact the opposite sides of the plate section and bite onto the opposite sides as the connector bars are clamped against each other. In the present invention, the irreversibility of the connection is maintained regardless of the thickness of the beam or busbar because, in one embodiment, the anti-reversal mechanism is installed after the clamp is installed.

In accordance with another aspect of the invention, an electrical connector is provided comprising a clamp connector comprising connector bars configured to be located on opposite sides of a plate section of a first member, wherein the connector bars are configured to be clamped against each other and against the plate section by at least one bolt; and a connector removal prevention device comprising lugs configured to be located on opposite sides of at least one nut connected to the bolt and surround lateral sides of the nut, and a fastener having a shear-off head configured to connect the lugs to each other. The shear-off head is adapted to disconnect from the fastener after connection of the lugs to each other by the fastener.

In accordance with another aspect of the invention, an electrical connector removal prevention device is provided comprising a first lug comprising a plurality of first through-holes and a threaded hole; a second lug comprising a plurality of second through-holes and a fastener hole, wherein the fastener hole comprises an interior ledge; and a fastener configured to be screwed into the threaded hole. The second through-holes are larger than the first through-holes. The fastener comprises a surface for contacting the interior ledge to clamp the first lug towards the second lug when the fastener is screwed into the threaded hole. The fastener comprises a shear-off head which is adapted to disconnect from the fastener after connection of the lugs to each other by the fastener.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
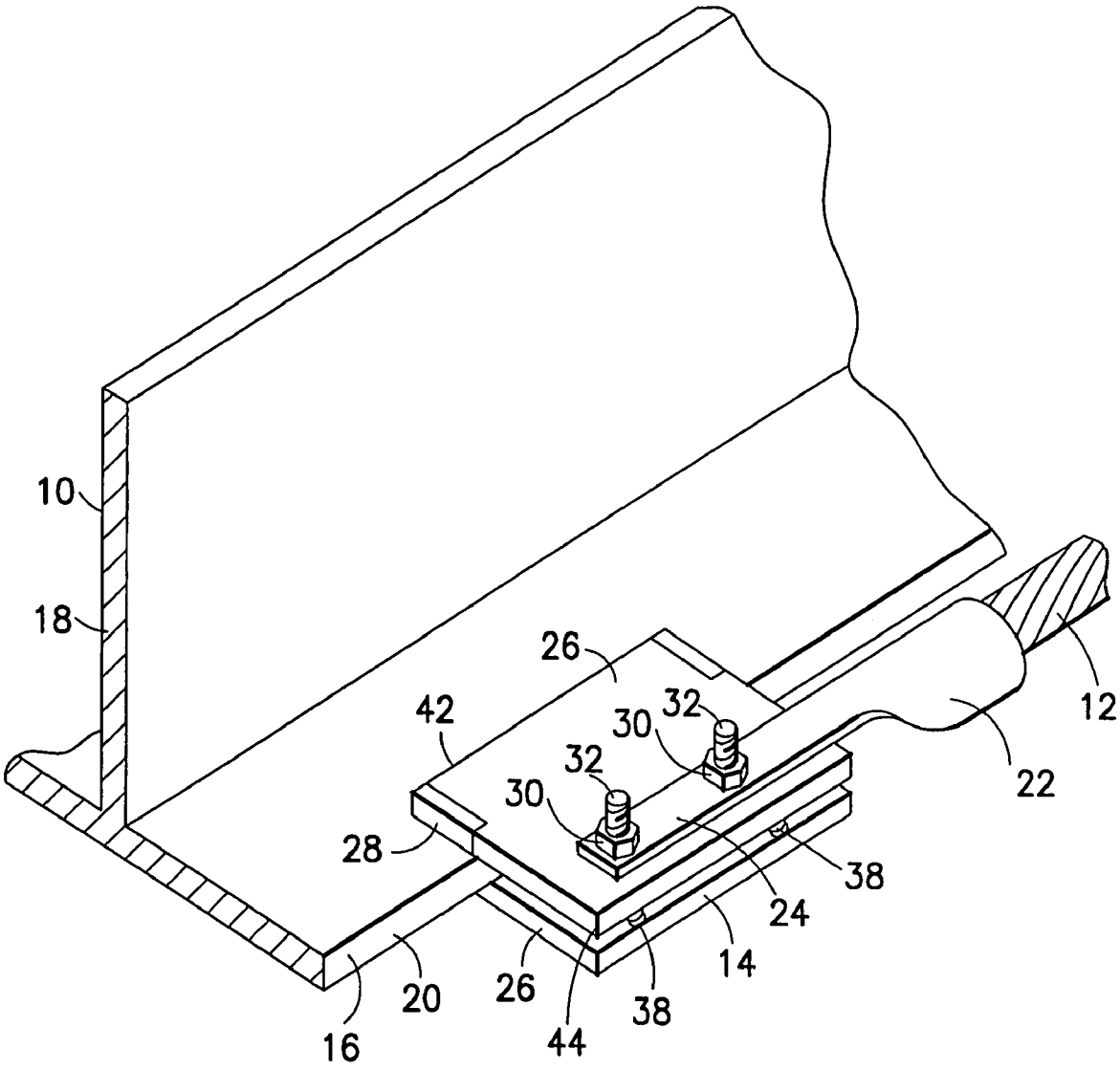
FIG. 1 is a perspective view illustrating connection of an electrical connector comprising features of the invention shown connecting an electrical conductor wire to a structural I-beam.
Figure 2:
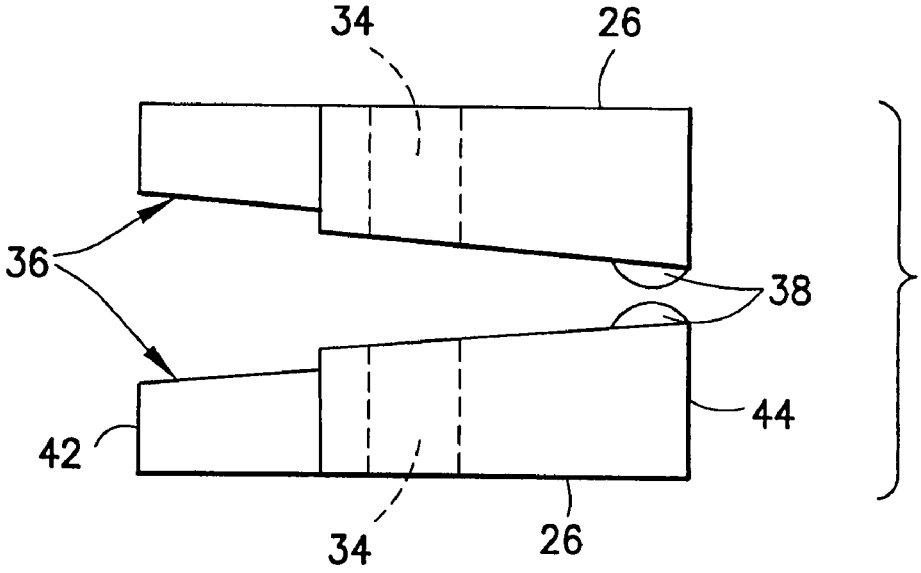
FIG. 2 is a side view of the two connector bars of the connector shown in FIG. 1.
Figure 3:
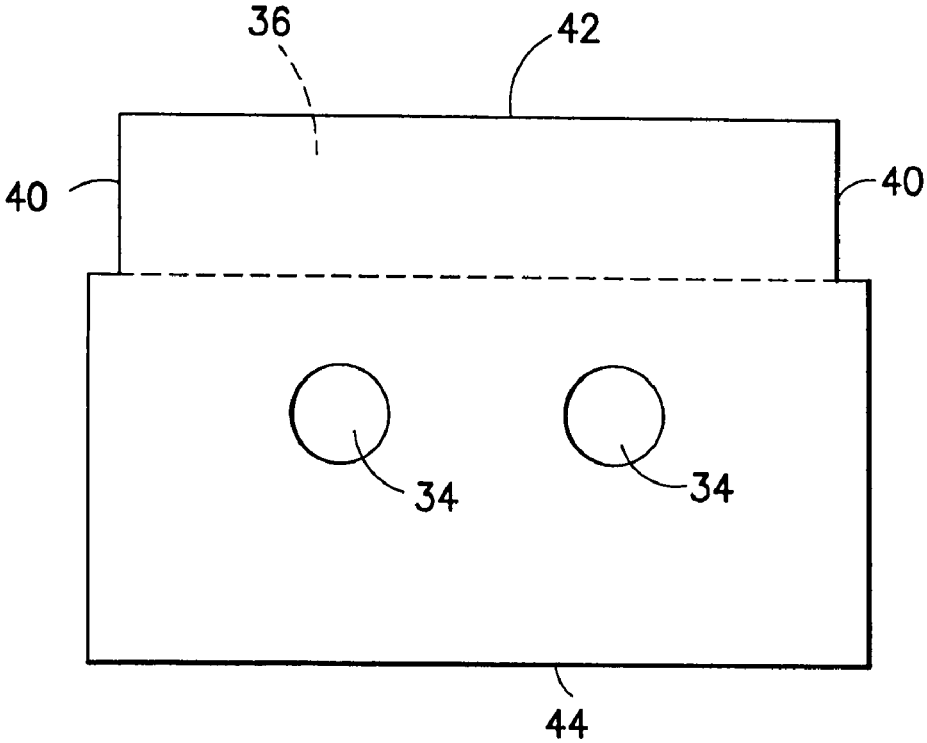
FIG. 3 is a top side view of one of the connector bars shown in FIG. 2.
Figure 4:
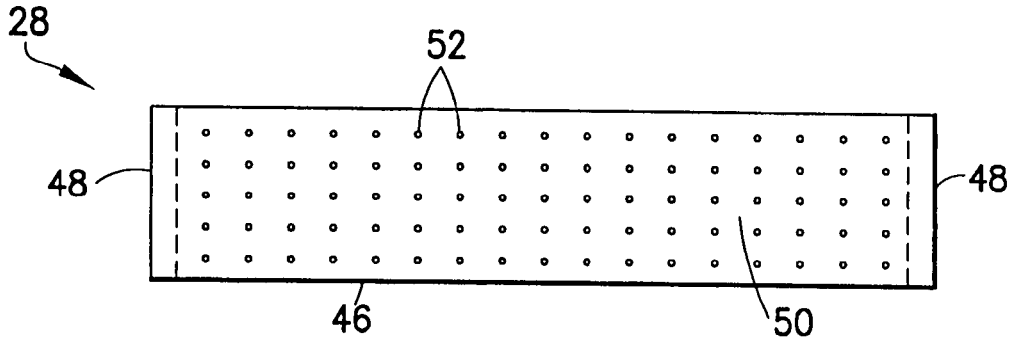
FIG. 4 is a plan view of one of the biting pads used in the connector shown in FIG. 1.
Figure 5:
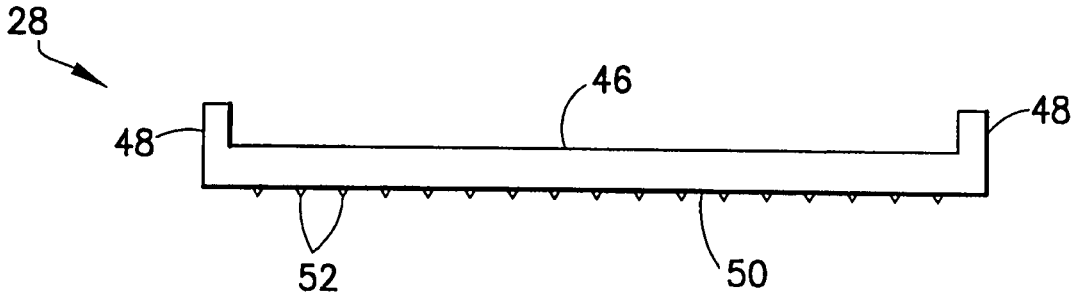
FIG. 5 is a side view of the biting pad shown in FIG. 4.

Referring to FIG. 1, there is shown a perspective view of a portion of an I-beam 10 having an electrical conductor 12 connected to it by an electrical connector 14 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The I-beam 10 has plate sections 16. The connector 14 is adapted to be connected to a portion of one of the plate sections 16; at an outer edge of the plate section. In alternate embodiments, the connector 14 could be used to connect the conductor 12 to any suitable member having a plate section and is not limited to use with I-beams, such as use with a busbar for example. As is known in the art, the plate section 16 could have a larger thickness closer to the web 18 than the outer edge 20. The connector 14 is adapted to adjust to this wedge shaped thickness variation.

The conductor 12, in this embodiment, is a wire conductor which can include an outer insulation cover. The insulation cover, if provided, is removed at the end of the conductor for connection to the connector 14. In this embodiment, the end of the conductor 12 comprises a conventional lug/barrel connector 22 which has been crimped onto the end of the conductor 12. The lug section 24 has two holes for mounting the lug section 24 on bolts of the connector 14. However, in alternate embodiments, any suitable type of conductor end connector could be provided.

Referring also to FIGS. 2-5, the connector 14 generally comprises two connector bars 26, two biting pads 28, and two pair of nuts 30 and bolts 32. The connector bars 26 have a general plate shape. In this embodiment the two connector bars 26 are identical; merely orientated reverse to each other. However, in alternate embodiments the connector bars 26 could be different. The connector bars 26 generally comprise two holes 34, two recessed seats 36, and projections 38. As seen best in FIG. 2, the connector bars 26 have a general wedge shaped side profile which tapers from the outer end 44 to the inner end 42. However, in alternate embodiments, the connector bars 26 could have any suitable side profile shape. For example, the side profile could be flat.

The holes 34 are sized and shaped to allow insertion of the bolts 32 to connect the bars 26 to each other. In alternate embodiments more or less than two holes in each bar could be provided. The recessed seats 36 are sized and shaped to allow the biting pads 28 to be mounted to the bars at the seats. The seats 36 have recessed side edges 40, are located at the inner ends 42 of the bars 26, and the seats 36 are located generally opposite each other. In an alternate embodiment, the seats could have any suitable shape configured to locate the biting pads on the connector bars. In another alternate embodiment, the biting pads might be integrally provided on the connector bars. Thus, the seats might not be provided.

The biting pads 28 could be comprised of a material different from the connector bars 26. The biting pads 28, in this embodiment, generally comprise a main section 46 and two end sections 48. The two end sections 48 are sized and shaped to be located in the recessed side edges 40. The main section 46 has a side 50 with protrusions or teeth or barbs 52. These protrusions 52 are adapted to bite into the outer surfaces of the plate section 16 of the I-beam when the connector 14 is attached to the I-beam 10. However, in alternate embodiments, the biting pads might not be provided and the protrusions 52 might be provided directly on the connector bars.

The projections 38 form stand-offs which are located at the outer ends 44 of the connector bars 26. The projections 38 are adapted to contact the projections on the opposite connector bar to space the main sections of the connector bars from each other at the outer ends 44 when the bars 26 are connected to each other.

The nuts 30 and bolts 32 may be off the shelf conventional nuts and bolts which can help to reduce the cost of the connector. When the nuts and bolts are connected to the connector bars 26, the lug section 24 of the lug/barrel connector 22 is also captured onto the top connector bar. This electrically connects the lug section 24 to the top connector bar 26.

The two connector bars 26 are located on opposite sides of the plate section 16 with the biting pads 28 against the opposite sides. As the nuts and bolts are tightened, the bars 26 are clamped together with a portion of the plate section 16 being clamped between the biting pads 28. The biting pads 28 are able to bite into the opposite sides of the plate section 16 to insure a good electrical connection between the plate section 16 and the connector 14. Thus, although the portion of the plate section 16 receiving the connector 14 might be grinded and a flux applied similar to the Thomas & Betts conventional connector, this is not necessary with the present invention.

Figure 6:
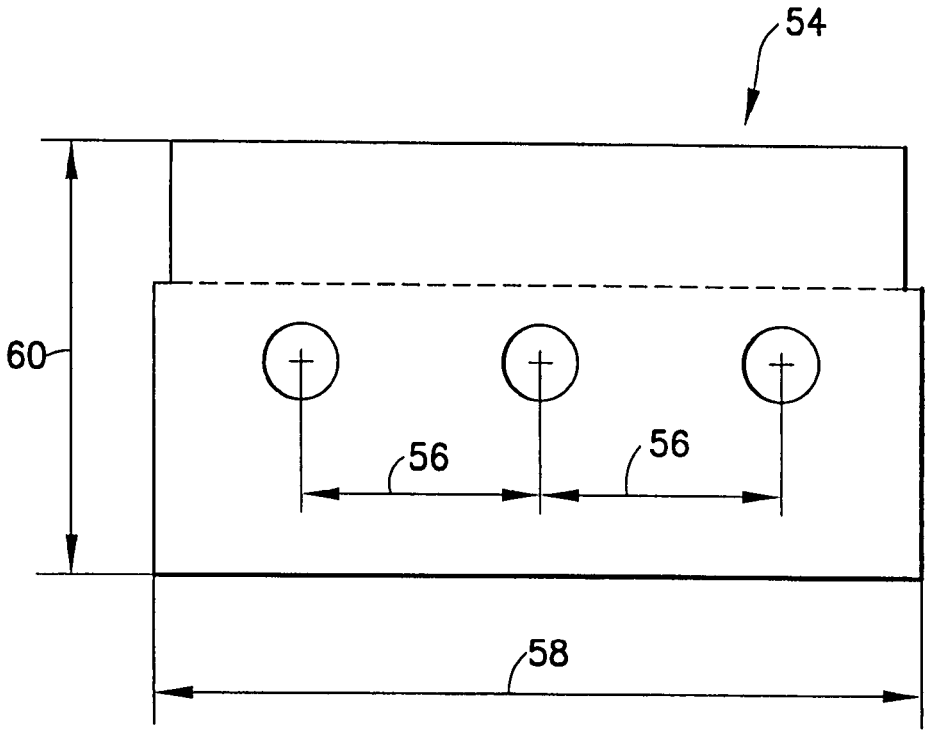
FIG. 6 is a plan view of an alternate embodiment of a connector bar.
Figure 7:
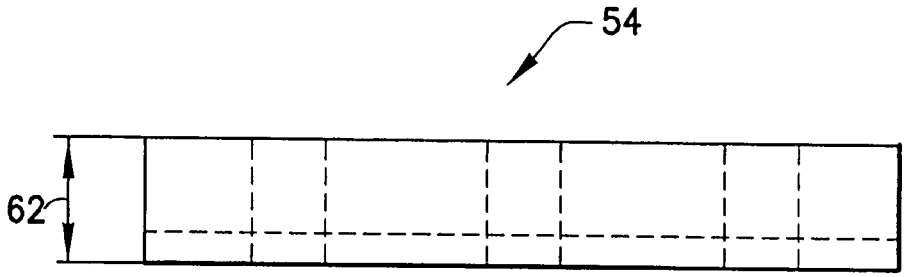
FIG. 7 is an end view of the connector bar shown in FIG. 6.

Referring also to FIGS. 6 and 7, an alternate embodiment of the connector plate is shown. In this embodiment the connector plate 54 has three bolt receiving holes. However, in alternate embodiments, more or less holes could be provided. The embodiment has dimensions 56, 58, 60 and 62. In one type of non-limiting example, 56 could be 1¾ inches, 58 could be 5¾ inches, 60 could be 3 inches, and 62 could be 1 inch. The holes could be ½ inch diameter holes for example.

Figure 9:
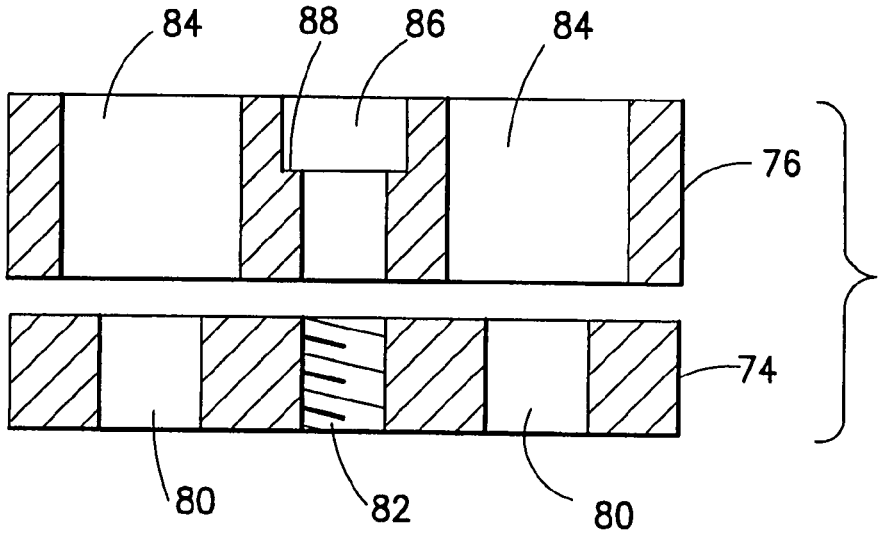
FIG. 9 is a cross sectional view of the lugs of the connector removal prevention device shown in FIG. 8.
Figure 10:
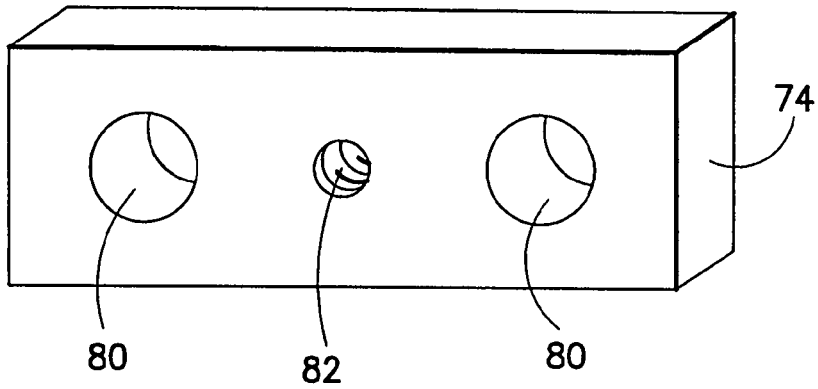
FIG. 10 is a perspective view of the bottom lug shown in FIGS. 8-9.
Figure 8:
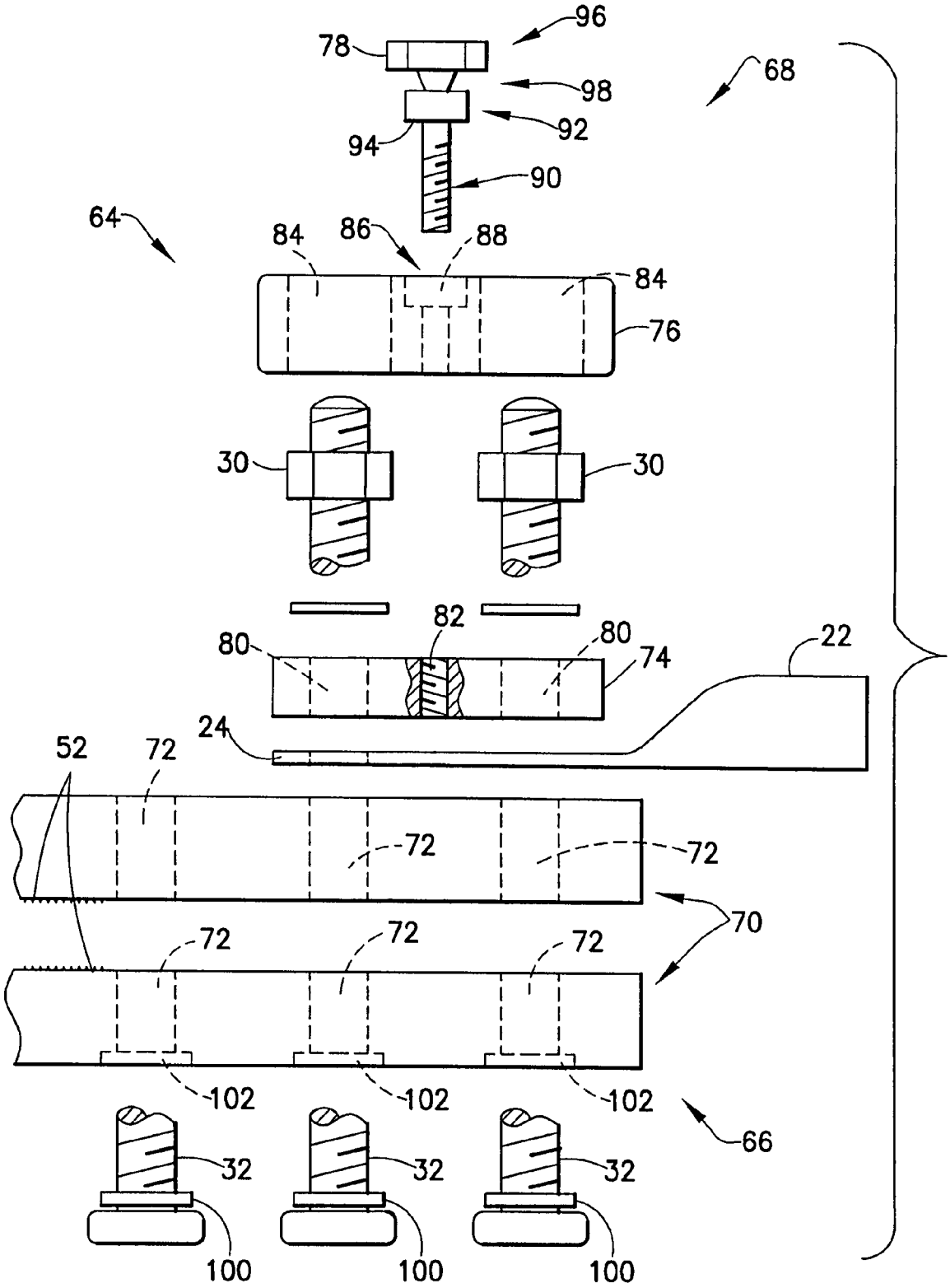
FIG. 8 is an exploded view of an alternate embodiment of the present invention with a connector removal prevention device.

Referring now to FIGS. 8-10, another alternate embodiment of the invention is shown. In this embodiment the connector 64 has a clamp connector 66 and a connector removal prevention device 68. The clamp connector 66 has two connector bars 70, and pairs of nuts 30 and bolts 32. In this embodiment, each bolt 32 has a member or section 100 that is received in a recess 102 in part 66. The member 100 prevents the bolt 32 from rotating so that a tool is not required at that end of the bolt during tightening. The biting protrusions 52 are integrally formed on the bars 70. However, biting pads could be provided similar to that shown in the first embodiment. The bars 70 each have holes 72 for the nuts and bolts. The holes are arranged in at least one row aligned outward from the biting protrusions 52. However, any suitable arrangement of holes could be provided. In an alternate embodiment, the bars could be the same as the bars 26.

The connector removal prevention device 68 generally comprises a first lug 74, a second lug 76, and a fastener 78. The first lug 74 comprises first through-holes 80 and a threaded hole 82. The second lug 76 comprises two second through-holes 84 and a fastener hole 86. The fastener hole 86 has in interior ledge 88. The second through-holes 84 are larger than the first through-holes 80. The first lug 74 can be positioned on top of the lug section 24 of the lug/barrel connector 22 with the two outer bolts 32 passing through the first through-holes 80. The nuts 30 can be tightened to fix the first lug 74 with the clamp connector 66. The second lug 76 can be positioned onto the top side of the first lug 74 with the nuts 30 being located in the second through-holes 84. The second lug 76, thus, surrounds the lateral sides of the nuts 30.

The fastener 78 has a threaded shaft 90 which is screwed into the threaded hole 82. The fastener 78 has an enlarged section 92 with a surface 94 for contacting the interior ledge 88. The fastener 78 is screwed into the lugs by a shear-off head 96. When the surface 94 and ledge 88 meet, and the head 96 is still turned while the shaft 90 is not able to turn, the head 96 can shear off at area 98 to leave the rest of the fastener inside the holes 86, 82 and inaccessible. The connector removal prevention device 68 is, thus, able to block access to the nuts 30 and prevent removal of the connector 64 from the I-beam. In alternate embodiments, any suitable type of fastener could be provided, and alternate shapes of lugs could be provided.

The connector removal prevention device 68 could be used with the connector 14 shown in FIG. 1. Alternatively, the connector removal prevention device 68 could be used with any suitable type of connector.

It should be understood that the foregoing description is only illustrative of the invention. Various alternatives and modifications can be devised by those skilled in the art without departing from the invention. For example, features recited in the various dependent claims could be combined with each other in any suitable combination(s). Accordingly, the invention is intended to embrace all such alternatives, modifications and variances which fall within the scope of the appended claims.

What is claimed is:

1. An electrical connector comprising:

a pair of separate connector bars configured to be located on opposite sides of a plate section of a first member, wherein the connector bars comprise holes to receive a bolt for clamping the connector bars directly against each other, wherein the connector bars are movably connected relative to each other by the bolt; and a pair of biting pads separately mounted to the connector bars at receiving seats of the connector bars, wherein the biting pads comprise surfaces which are configured to contact the opposite sides of the plate section and bite onto the opposite sides as the connector bars are clamped against each other, wherein the biting pads comprise a different material than the connector bars.

2. An electrical connector as in claim 1 wherein the connector bars are mirror images of each other.

3. An electrical connector as in claim 2 wherein the connector bars comprise a general wedge shaped side profile.

4. An electrical connector as in claim 3 wherein the connector bars comprise projecting standoffs at an outer end of the bars which contact each other.

5. An electrical connector as in claim 1 wherein the connector bars comprise a general wedge shaped side profile.

6. An electrical connector as in claim 1 wherein the connector bars comprise projecting standoffs at an outer end of the bars which contact each other.

7. An electrical connector as in claim 1 further comprising a connector removal prevention device comprising lugs configured to be located on opposite sides of at least one nut connected to the bolt and surround lateral sides of the nut, and a fastener having a shear-off head configured to connect the lugs to each other, wherein the shear-off head is adapted to disconnect from the fastener after connection of the lugs to each other by the fastener.

8. An electrical connector as in claim 7 wherein the lugs comprise:

a first lug comprising a plurality of first through-holes and a threaded hole; and a second lug comprising a plurality of second through-holes and a fastener hole, wherein the fastener hole comprises an interior ledge, wherein the second through-holes are larger than the first through-holes.

9. An electrical connector comprising:

a clamp connector comprising connector bars configured to be located on opposite sides of a plate section of a first member, wherein the connector bars are configured to be clamped against each other and against the plate section by at least one bolt; and a connector removal prevention device comprising lugs configured to be located on opposite sides of at least one nut connected to the bolt and surround lateral sides of the nut, and a fastener having a shear-off head configured to connect the lugs to each other, wherein the shear-off head is adapted to disconnect from the fastener after connection of the lugs to each other by the fastener.

10. An electrical connector as in claim 9 wherein the clamp connector comprises biting pads connected in recessed seats of the connector bars.

11. An electrical connector as in claim 9 wherein the connector bars comprise a general wedge shaped side profile, and wherein the connector bars comprise projecting standoffs at an outer end of the bars which contact each other.

12. An electrical connector as in claim 9 wherein the lugs comprise:

a first lug comprising a plurality of first through-holes and a threaded hole; and a second lug comprising a plurality of second through-holes and a fastener hole, wherein the fastener hole comprises an interior ledge.

13. An electrical connector as in claim 12 wherein the fastener comprises a surface for contacting the interior ledge to clamp the first lug towards the second lug when the fastener is screwed into the threaded hole.

14. An electrical connector removal prevention device comprising:

a first lug comprising a plurality of first through-holes and a threaded hole;

a second lug comprising a plurality of second through-holes and a fastener hole, wherein the fastener hole comprises an interior ledge, and wherein the second lug is configured to at least partially surround a fastener nut at each of the plurality of second through holes; and a fastener configured to be screwed into the threaded hole, wherein the fastener comprises a surface for contacting the interior ledge to clamp the first lug towards the second lug when the fastener is screwed into the threaded hole, and wherein the fastener comprises a shear-off head which is adapted to disconnect from the fastener after connection of the lugs to each other by the fastener, wherein the second through-holes are larger than the first through-holes.

15. An electrical connector comprising:

a pair of connector bars configured to be located on opposite sides of a plate section of a first member, wherein the connector bars comprise holes to receive a bolt for clamping the connector bars against each other;

a pair of biting pads connected to the connector bars, wherein the biting pads comprise surfaces which are configured to contact the opposite sides of the plate section and bite onto the opposite sides as the connector bars are clamped against each other; and an electrical connector removal prevention device as in claim 14.

16. An electrical connector as in claim 15 wherein the connector bars are mirror images of each other.

17. An electrical connector as in claim 16 wherein the connector bars comprise a general wedge shaped side profile.

18. An electrical connector as in claim 17 wherein the connector bars comprise projecting standoffs at an outer end of the bars which contact each other.

19. An electrical connector as in claim 15 wherein the connector bars comprise projecting standoffs at an outer end of the bars which contact each other.

20. An electrical connector configured to be compressed onto a conductor, the electrical connector comprising:

a plurality of conductor bars;

at least one first fastener that is tightened to compress the conductor bars onto the conductor; and a connector removal prevention device configured to prevent the at least one first fastener from being untightened after the conductor bars are compressed onto the conductor by the at least one first fastener, wherein the connector removal prevention device is configured to at least partially surround a fastener nut connected to the at least one first fastener, and wherein the connector removal prevention device comprises a second fastener having a shear-off head.

21. An electrical connector as in claim 20 wherein the connector removal prevention device comprises at least one lug configured to cover at least a portion of the at least one first fastener.

* * * * *